US005702274A

United States Patent [19]

White

[11] Patent Number: 5,702,274

[45] Date of Patent: Dec. 30, 1997

[54] FLOTATATION DEVICE PROPELLED BY HUMAN-POWERED SKI MACHINE

[76] Inventor: Robert D. White, P.O. Box 334, Newton, Ill. 62448-0334

[21] Appl. No.: 580,148

[22] Filed: Dec. 28, 1995

Related U.S. Application Data

[63] Continuation-in-part of Ser. No. 498,930, Jul. 6, 1995, Pat. No. 5,547,406.

[51] Int. Cl.[6] ..... B63H 16/00

[52] U.S. Cl. ..... 440/21; 440/24; 114/61

[58] Field of Search ..... 440/12, 13, 24, 440/21, 26, 27, 30, 31, 32; 114/61, 123, 220

[56] References Cited

U.S. PATENT DOCUMENTS

| | | | |
|---|---|---|---|
| 1,034,278 | 7/1912 | Munsen . | |
| 3,352,276 | 11/1967 | Zimmerman . | |
| 3,570,436 | 3/1971 | Le Vasseur | 440/31 |
| 3,709,185 | 1/1973 | Hennel . | |
| 3,982,495 | 9/1976 | Hill . | |
| 4,023,795 | 5/1977 | Pauls | 272/97 |
| 4,092,945 | 6/1978 | Ankert et al. . | |
| 4,285,674 | 8/1981 | Chew . | |
| 4,427,392 | 1/1984 | Schneider . | |
| 5,224,886 | 7/1993 | Cunningham . | |
| 5,387,140 | 2/1995 | Cunningham | 440/12 |
| 5,547,406 | 8/1996 | White | 440/12 |

*Primary Examiner*—Stephen Avila
*Attorney, Agent, or Firm*—Patterson & Streets, L.L.P.

[57] ABSTRACT

A floatation device with propeller drive assembly and steerable rudder for use with a ski machine allowing an individual the ability to have a self propelled water craft. The device utilizes a ski machine having a rotating flywheel to provide power for the propeller unit. The ski machine is temporarily mounted to the floatation device with the flywheel in frictional engagement with a drive pulley that transmits power to the propeller unit. A steering mechanism is included to allow the operator to pedal the device across a body of water and back. The ski machine does not require modification and can be easily and quickly removed from the device.

23 Claims, 8 Drawing Sheets

FLOTATATION DEVICE PROPELLED BY HUMAN-POWERED SKI MACHINE

This is a continuation-in-part of U.S. patent application Ser. No. 08/498,930, filed on Jul. 6, 1995 now U.S. Pat. No. 5,547,406.

FIELD OF THE INVENTION

The present invention relates to human powered floatation devices. More particularly, the invention relates to a floatation device with propeller and steerable rudder that are powered by a ski machine or other human powered machine that provides rotational force to a flywheel.

BACKGROUND OF THE DISCLOSURE

The development of individual pedal-powered floatation devices began at least as early as 1967, when Zimmerman (U.S. Pat. No. 3,352,276) was issued. Zimmerman discloses a pontoon boat having a seat, pedals and handlebars, each uniquely designed for use on the boat, attached in a configuration similar to a bicycle. However, the seat, pedals and handlebars were dedicated for use with the pontoon boat and could not be used with a functioning bicycle.

Hennel (U.S. Pat. No. 3,709,185) discloses an amphibious motor bike capable of operating on land and carrying the necessary equipment for traveling over water. Before traveling over water, sectionalized pontoons are taken from the side carriers to be assembled and inflated. A water paddle is mounted onto the rear wheel to be rotated thereby and thus propel the motor bike over the water. Steering is controlled by the front handlebars after a rudder swings downward into place below the front wheel. However, this water-going vessel is not very maneuverable.

Hill (U.S. Pat. No. 3,982,495) discloses a bicycle powered boat having an integrated, hydrodynamically shaped hull comprising forward and rear hull sections uniquely designed to be secured to and driven by a conventional bicycle. Both hull sections could be mounted on and carried on a rear bicycle carrier or be removed from the bicycle entirely. This device uses a rudder on the forward hull to steer. The vessel is powered by a propeller coupled to a friction roller engaging the rear bicycle wheel. However, reliance on friction for transmission of power to the propeller is less than desirable, especially when the wheel and roller will invariably get wet.

Ankert et al. (U.S. Pat. No. 4,092,945) discloses a float for attachment to the frame and axles of a standard bicycle. The bicycle pedals are provided with paddle means and the front wheel is provide with a rudder. However, the paddles provide very low power and efficiency of effort.

Chew (U.S. Pat. No. 4,285,674) discloses a float for a standard bicycle, similar to Ankert et al. above, except that the front wheel is provided with a solid circular disc to act as a rudder and the spokes of the back wheel have impeller cups or vanes attached thereto. However, this arrangement is also low in power and efficiency.

Schneider (U.S. Pat. No. 4,427,392) discloses an outboard propeller drive and steering assembly for a boat. The pedal driven system utilizes a plurality of gears, sprockets, and universal joints to provide a propeller that is steerable with a single rotating hand grip. However, the system is dedicated to use with a specially designed boat and the gear ratio is fixed.

Cunningham (U.S. Pat. No. 5,224,886) discloses a pontoon with a tubular structure to support a standard bicycle. The front wheel is removed and the front fork is attached to a support that is connected to a front rudder. The rear wheel of the bicycles rests on a rotating drum to transfer power to the drive propeller. However, the device still suffers from many of the problems mentioned above.

Cunningham (U.S. Pat. No. 5,387,140) discloses a pontoon with a tubular structure to support a standard bicycle having a combined propeller/rudder unit. The rear wheels of the bicycle rest on a rotating drum to transfer power through a flexible drive shaft to the drive propeller. The front fork is connected with an elaborate directional control system that operates to turn the apparatus in the direction of the handle bars.

Despite the above attempts to provide a human powered floatation device, there remains a need for an improved device providing greater efficiency of effort, increased power and thrust, tighter steering, and a more comfortable arrangement. It would be desirable if the device would allow for the use of equipment already owned by the operator, rather than requiring the purchase of the entire unit. Furthermore, it would be desirable if the equipment could be quickly and easily mounted and dismounted from the device for use with or without the device. It would also be desirable if the device would interface with equipment that would provide the user with effective exercise.

SUMMARY OF THE INVENTION

The present invention provides a human-powered floatation device for use with an exerciser device having a flywheel, comprising: floatation means having sufficient buoyancy and stability to allow an exerciser device and rider to maintain their balance on a surface of water; means for firmly disconnectably connecting the exerciser device to the floatation means; a drive pulley mounted on the floatation means for engagement with the flywheel, wherein the drive pulley receives rotational forces from the flywheel; a propeller drive assembly having a propeller, the propeller drive assembly coupled to the drive pulley for communicating the rotational force to the propeller; and a steering mechanism having a rudder. The preferred exerciser is a ski machine.

In another aspect of the invention, a propeller drive assembly is provided comprising: a transverse axle disconnectably connected to the rear mounting brackets; a drive gear assembly mounted concentrically about the axle comprising a chain sprocket rigidly coupled to an upper drive belt sprocket, and first and second bearings fixed at opposite ends of the assembly and engaging the axle to allow the assembly to spin freely about the axle; a rigid, water-tight housing downwardly depending from the axle having an inner wall; a lower bearing attached to the inner wall of the housing and having a rearwardly extending axis of rotation; a propeller shaft extending through the lower bearing having a propeller attached to a first end and a lower drive belt sprocket coupled to a second end; a drive belt frictionally engaging the upper and lower drive belt sprockets; upper and lower idlers coupled to the housing wall adjacent the upper and lower drive belt sprockets respectively, wherein one of the idlers is adapted to adjust the tension on the drive belt; wherein the housing substantially encloses the upper and lower drive belt sprockets and the upper and lower idlers, and wherein the chain sprocket cluster is freely accessible for engagement with a bicycle chain so that pedaling the bicycle causes the propeller to push the floatation device forward.

DETAILED DESCRIPTION

Figure 1:
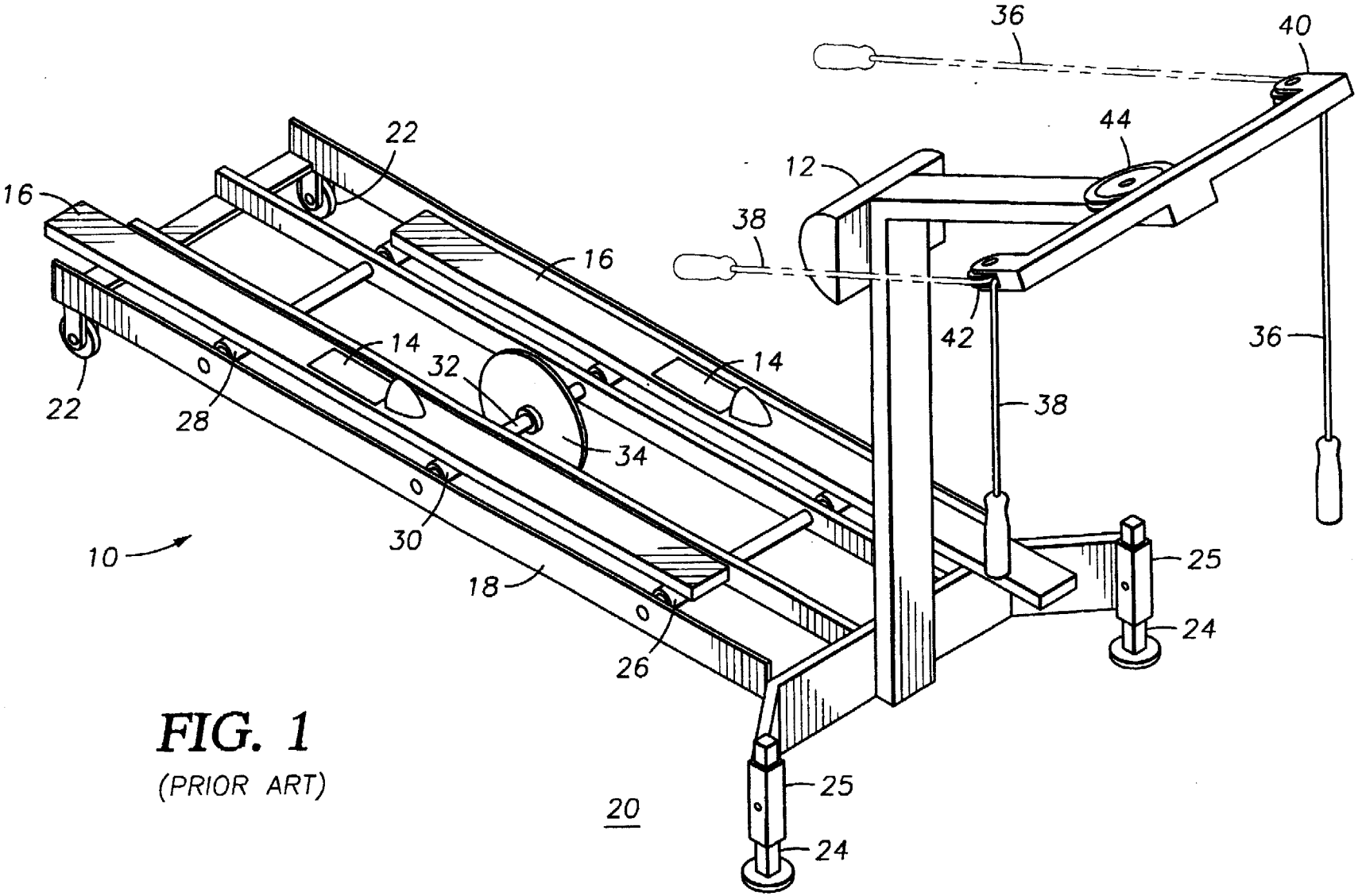
FIG. 1 (PRIOR ART)
FIG. 1 is a perspective view of a ski machine for use with the present invention.

Ski machines have become an increasingly popular form of cardiovascular exercise due to its total body workout and low impact. However, ski machines presently available, such as ski machine 10 shown in FIG. 1, are stationary. While the person exercising on a ski machine may listen to music or watch television, they are unable to experience movement through the outdoors and explore. The present invention provides a floatation device for use with an existing exercise ski machine allowing an individual the ability to have a human powered and controlled water craft.

Now referring to FIG. 1, a presently available ski machine 10 is shown generally. The construction and operation of this ski machine is set out in U.S. Pat. No. 4,023,795 entitled "Cross-Country Ski Exerciser", which is incorporated herein by reference. The base 18 rests on a stationary surface 20 at rear wheels 22 and front supports 24 extending from the front support collars 25. The bottom surface of each ski 16 engages a front idler roller 26, a rear idler roller 28, and a drive roller 30. A person stands facing the hip pad 12 with one foot on each of the slip-resistant foot pads 14 of each ski 16. As a ski 16 is pushed rearward with the person's leg, the drive roller 30 engages the cross shaft 32 through a one way clutch mechanism (not shown) to cause rotation of the shaft 32 and the flywheel 34 that is rigidly attached thereto. When each ski 16 is pulled forward, the drive roller 30 rotates in the opposite direction, releasing the clutch and having no significant effect on the continued rotation of the flywheel 34. In this manner, both skis 16 are alternatingly used to drive the flywheel 34 in the same direction. The mass of the flywheel 34 is preferably great enough to continue rotation for a short period between strides. Optional devices can be used to engage the flywheel to provide increased resistance to the skis 16.

The hand-held arm exercise ropes 36,38, which simulate the motion of using ski poles, are simply a pair of ropes connected through individual pulleys 40, 42 to a third pulley 44 having controllable frictional resistance. A ski machine of the type just described that is compatible with the present invention may be obtained from NordicTrack, located in Chaska, Minn., under the trademark NORDICTRACK.

Figure 2:
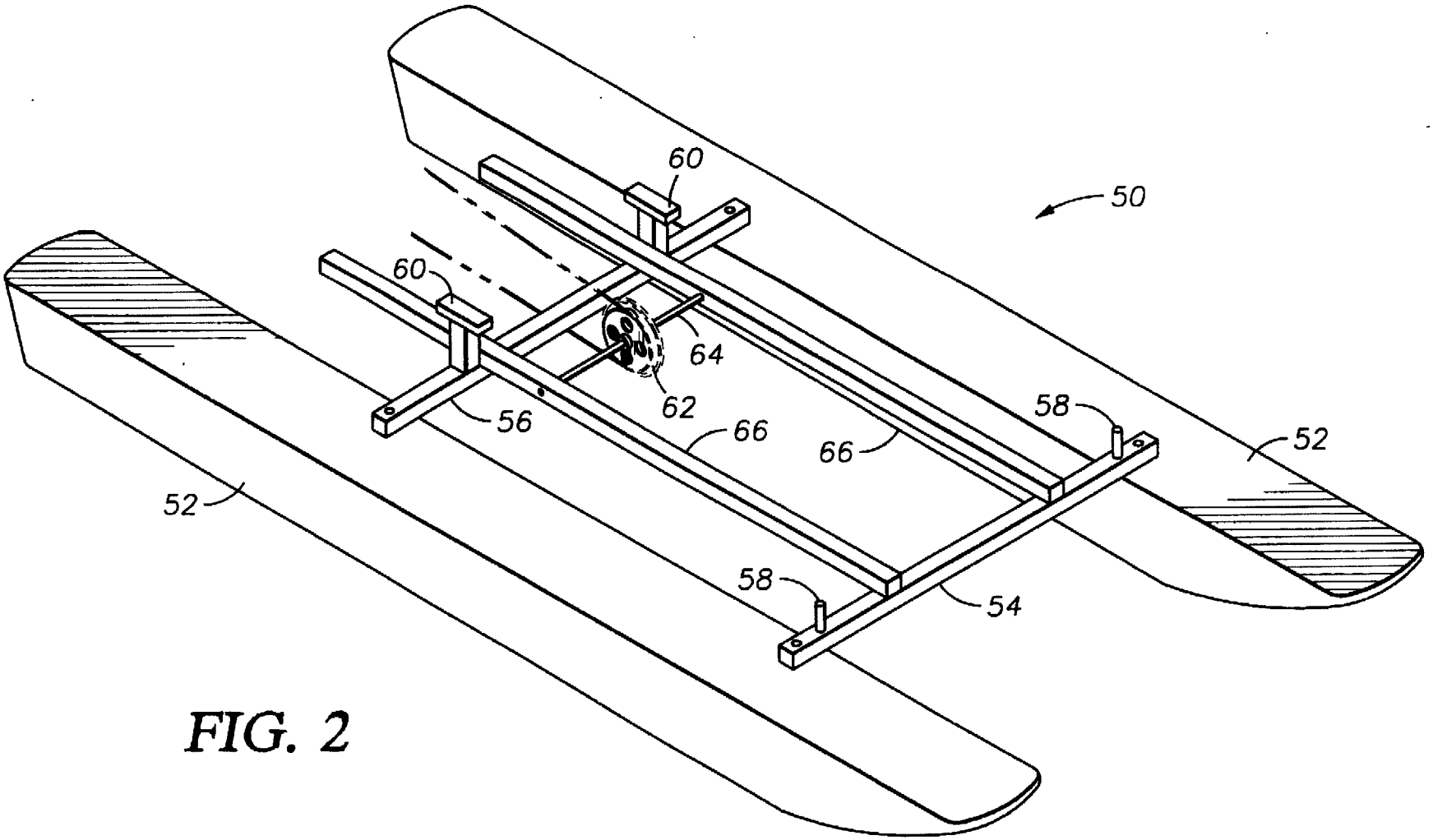
FIG. 2 is a perspective view of the present invention adapted for mounting with a ski machine.

Now referring to FIG. 2, a floatation device 50 is partially shown to include pontoons 52 connected by cross bars 54 and 56. The front cross bar 54 has two pegs 58 spaced and sized to cooperate with the front support collars 25. The second cross bar 56 has two support pads 60 sized and positioned to support the two sides of base 18 at an appropriate elevation so that the flywheel 34 will firmly engage the drive pulley 62 suspended by axle 64 between longitudinal supports 66.

Figure 3:
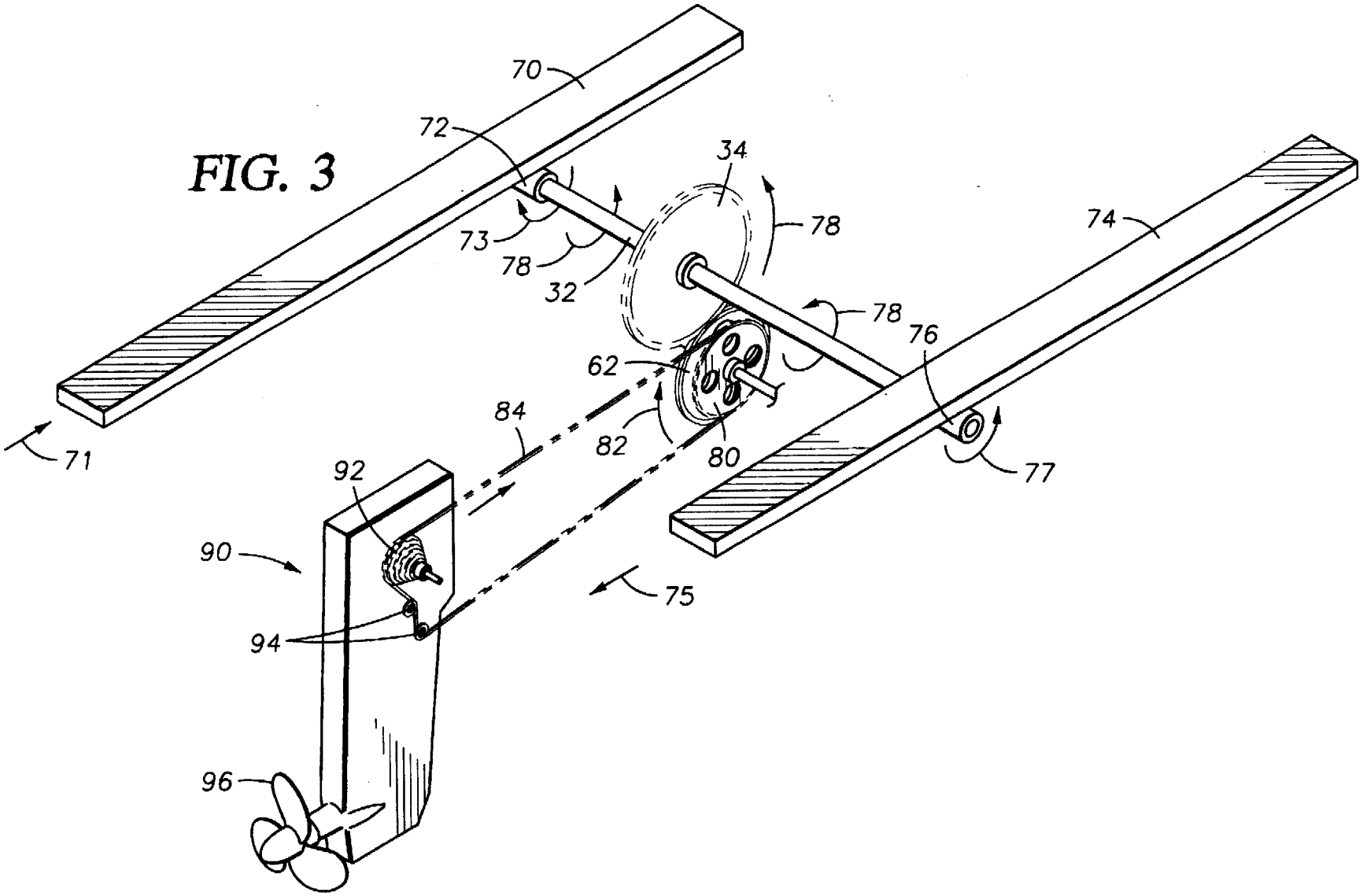
FIG. 3 is an operational diagram of a drive pulley and axle assembly that frictionally engages the flywheel and transfers mechanical forces from the ski machine to the propeller unit.

Now referring to FIG. 3, an operational diagram of a drive pulley and axle assembly that frictionally engages the flywheel and transfers mechanical forces from the ski machine to the propeller unit is shown. As stated above, when a ski 70 under the weight of a person is pulled forward (arrow 71), the drive roller 72 rotates (clockwise arrow 73 in the view shown) so that an internal clutch mechanism (not shown) does not grasp the axle 32, but rather the roller 72 freewheels about the axle 32. Conversely, when ski 74 is pushed rearward (arrow 75), the drive roller 76 rotates (counterclockwise arrow 77 in the view shown) so that an internal clutch mechanism (not shown) grasps the axle 32 causing the axle 32 and flywheel 34 to rotate in the same direction (arrow 78).

The flywheel 34 is placed in frictional engagement with the drive pulley 62 under the weight of the ski machine 10 and the person thereon (not shown). The drive pulley 62 is preferably made of a hard rubber, elastomer or other material having a high coefficient of friction and sufficient pliability to maintain intimate contact with the flywheel 34 as it turns many rotations per minute. Coupled to the drive pulley 62 and/or the axle 32 is a drive gear 80, preferably a standard shimano gear used on most bicycles. This drive gear 80 rotates which the drive pulley 62 in the opposite direction of the flywheel 34 as indicated by arrow 82. The drive gear 80 engages and pulls a chain 84, such as a standard bicycle chain.

The chain 84 forms a continuous loop passing over and around the drive gear 80 as well as the drive gear assembly 92, including the rear derailer 94, of the propeller unit 90. The pulling force on chain 84 turns the drive gear assembly 92 as various rotational speeds depending upon the particular gear is being used. The internal operation of the propeller unit 90, to be described below, transfers the rotation of the drive gear assembly 92 to the propeller 96 which, in turn, pushes the floatation device forward in the water (not shown).

Figure 4:
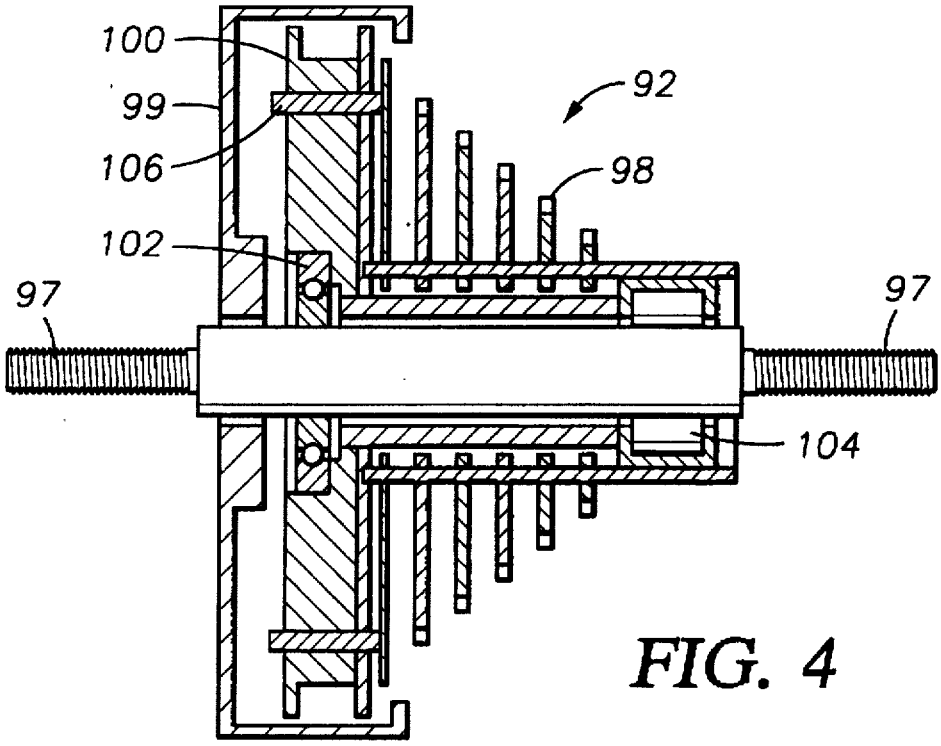
FIG. 4 is a cross-sectional rear view of a drive gear assembly and housing in position relative to the axle.

Now referring to FIG. 4, the drive gear assembly 92 is shown in place around the axle 97 and being partially enclosed by the rigid housing 99. The drive gear assembly 92 itself comprises a chain sprocket 98 rigidly coupled to an upper drive belt sprocket 100 with first and second bearings 102,104 fixed at opposite ends of the assembly 92 and engaging the axle 97 to allow the assembly to spin freely about the axle. While it is preferred that the drive gear assembly be molded together, the chain sprocket 98 and upper drive belt sprocket 100 may be fastened or reinforced with a screw or other suitable fastener 106.

Figure 5:
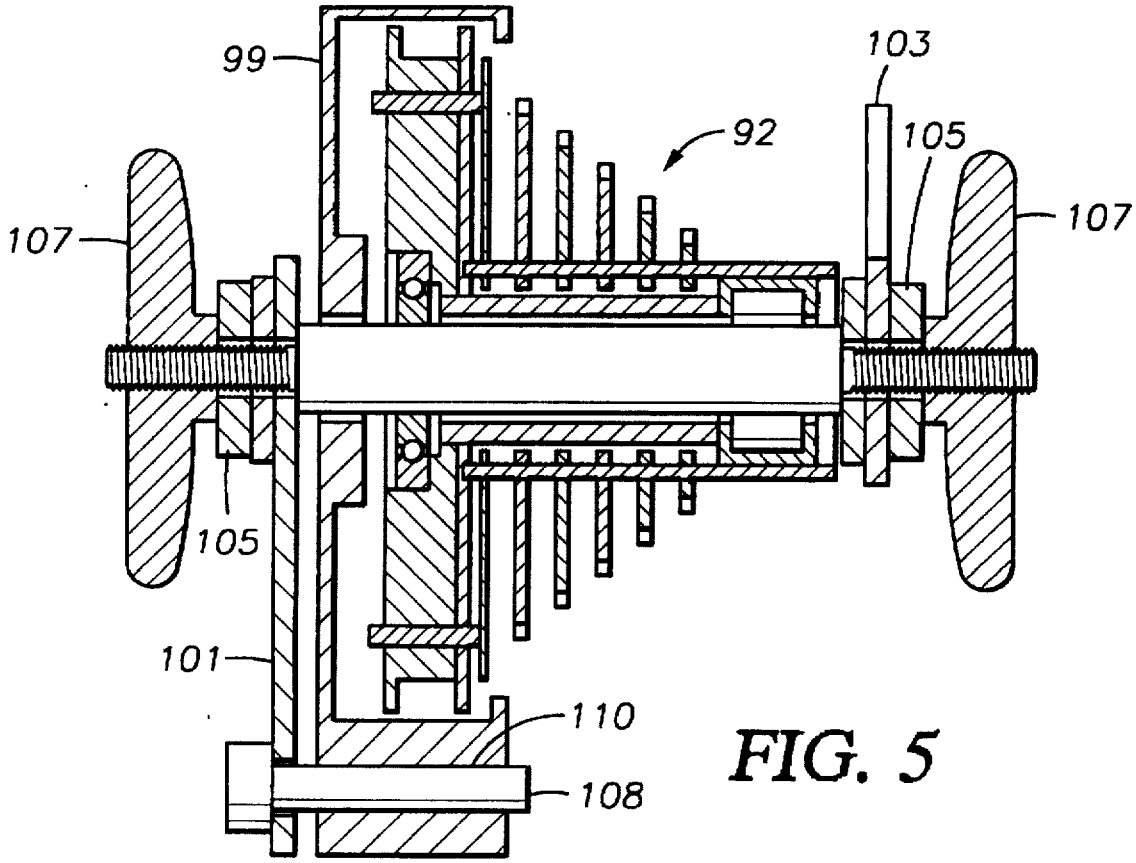
FIG. 5 is a cross-sectional rear view of the drive gear assembly and housing of FIG. 10 positioned in the rear mounting brackets and showing a position lock pin.

FIG. 5 shows the axle 97, housing 99, and drive gear assembly 92 of FIG. 4 mounted between the rear mounting brackets 101,103. The brackets 101,103 straddle the drive gear assembly 92 and housing 99 and hold the propeller unit 90 firmly in position by using washers 105 and threaded knobs 107. FIG. 5 also shows a lock pin 108 which is inserted through some portion of the floatation device, illustrated here as the mounting bracket 101, and into a reinforced hole 110 in the housing 99. In this manner, the propeller unit 90 can be locked into a downward position for operation or in an upward, stowing position. Alternatively, a metal bracket may be swung into position to hold the housing either up or down.

Figure 6:
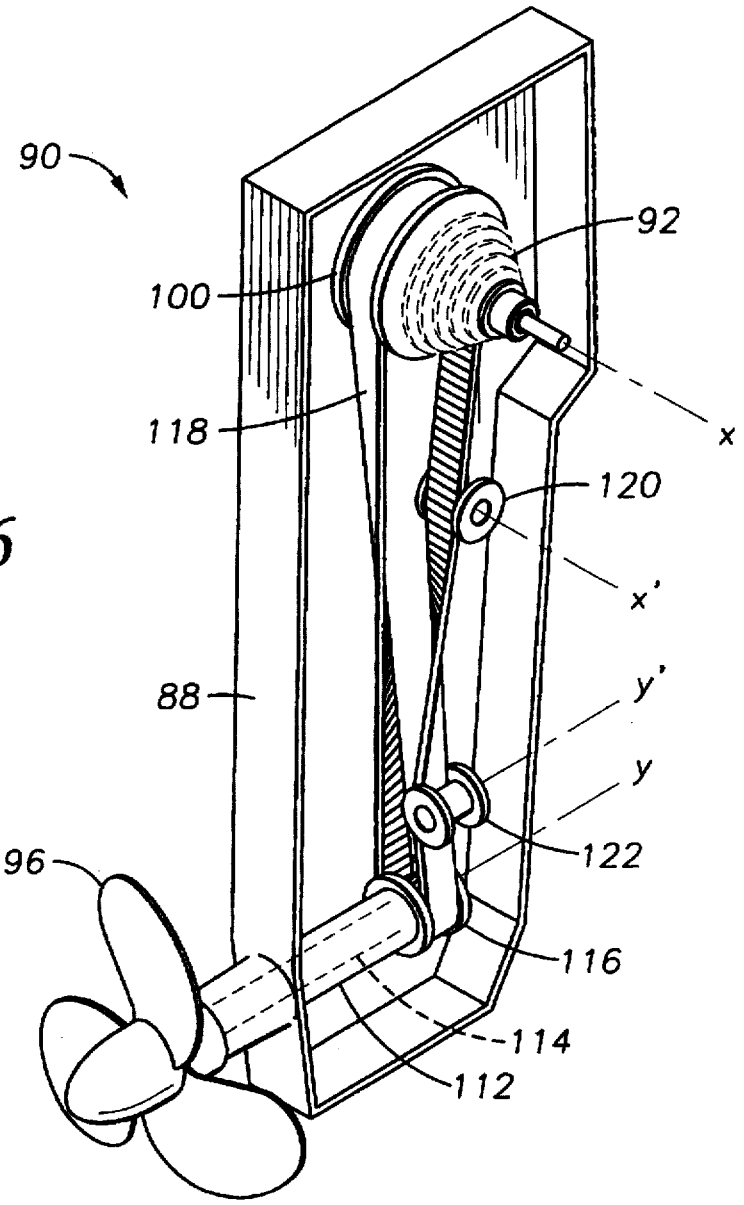
FIG. 6 is a side view of the propeller drive assembly of FIG. 9 having one side of the housing removed.
Figure 7:
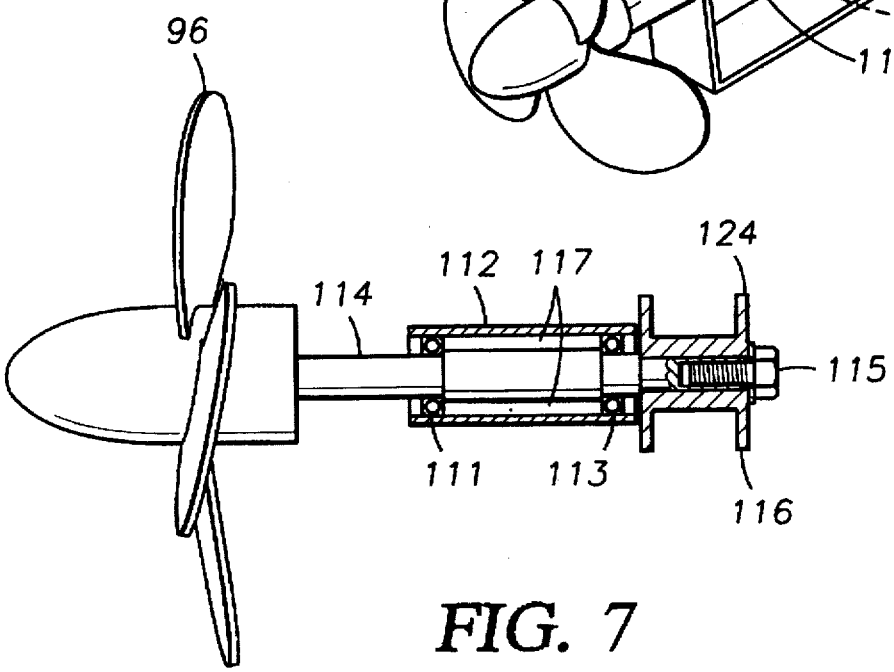
FIG. 7 is a cross-sectional view of a propeller, propeller bearing, and lower drive belt sprocket.

Now referring to FIG. 6, the propeller unit 90 is illustrated with one side of the housing 99 removed. The drive gear assembly 92 is located near the top of the propeller unit 90. Near the base of the housing 99 is a lower bearing assembly 112, propeller shaft 114, lower drive belt sprocket 116 and propeller 96. Referring briefly to FIG. 7, the propeller mechanism is shown in greater detail. In particular, note that the lower drive belt sprocket 116 is attached to the end of the propeller shaft 114 with a bolt 115. The lower bearing assembly 112 is made up of two beatings 111 and 113 and is filled with packing 117 such as greased rope.

Referring back to FIG. 6, a heavy torque drive (HTD) cog belt 118 is wrapped over the upper belt drive sprocket 100 and around the lower belt drive sprocket 116. The HTD cog belt 118 is held firmly around both drive sprockets by upper and lower idlers 120,122. It is preferred that one of the idlers, particularly the upper idler, be adjustable to maintain proper tension on the belt 118. It is very important to note that the drive gear assembly 92 and upper idler 120 rotate or spin around the axis labeled x and x' and the lower drive belt sprocket 116 and lower idler 122 rotate or spin around the axis labeled y and y'. Because the x and x' axis are perpendicular (a 90 degree angle) to the y and y' axis, the belt 118 must be twisted the same 90 degrees. In order to operate the twisted belt without it jumping off track, it is preferred that the drive belt sprockets 100,116 and idlers 120,122 have wide flanges (see FIG. 7 at point 124 for example) to guide the belt. This is particularly important for the smaller diameter sprocket 116 and the idlers 120,122.

Figure 8:
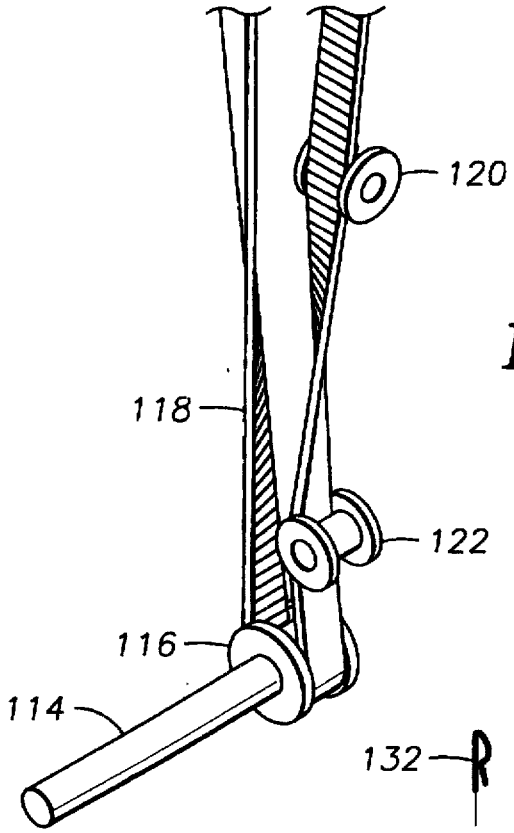
FIG. 8 is a perspective view showing the relative positioning of the lower drive belt sprocket to the lower idler and drive belt.
Figure 9:
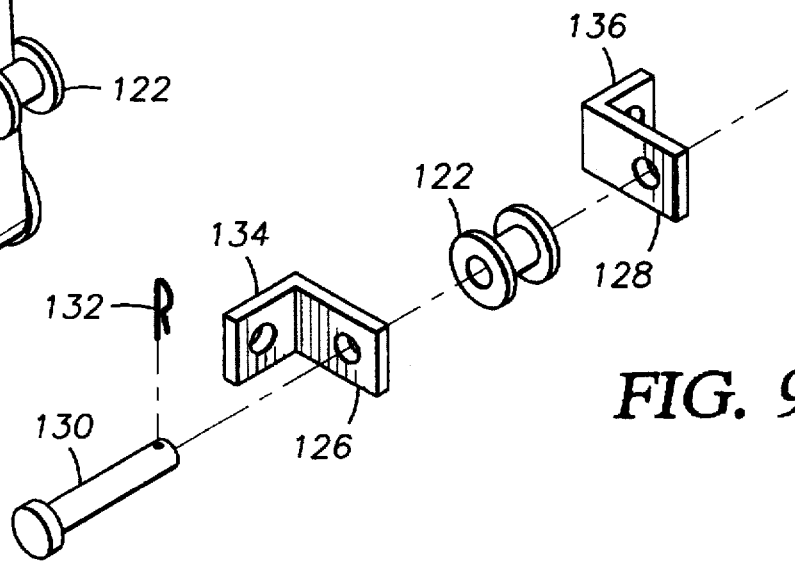
FIG. 9 is an exploded plan view of the lower idler.

FIG. 8 illustrates how the belt 118 wraps around the lower drive belt sprocket 116. The belt 118 may pass either over or under the lower idler 122, but is preferably passed over. FIG. 9 illustrates how the lower idler 122 is assembled using two angle irons 126,128 and a pin 130 and clasp 132. It is preferred that the base surfaces 134, 136 of the angle irons 126,128 be permanently secured to the wall of the housing 99. While the irons may be secured by any known technique, it is preferred that the irons be secured by using fiberglass and resin.

Figure 10:
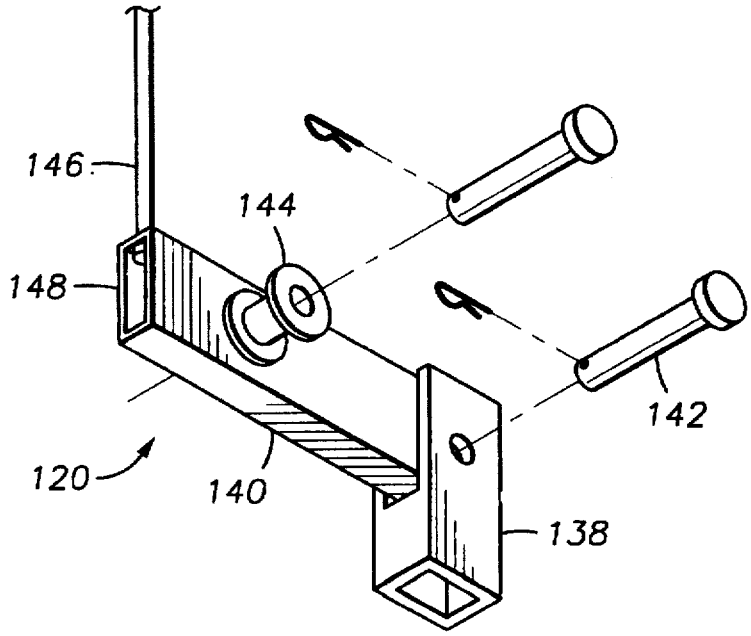
FIG. 10 is an bottom plan view of the upper idler.

Referring now to FIG. 10, a bottom view of the upper idler 120 is shown to be a tensioned idler. The idler 120 is comprised of a stationary base 138 affixed to the wall of the housing 99, a swing arm 140 connected to the base 138 by a pivot pin or bolt 142, the idler pulley 144 mounted on the swing arm, and the tension spring 146. The tension spring 146 extends from the distal end 148 of the swing arm 140 to a connection with a structural member of the housing. The tension spring 146 pulls the idler pulley 144 against the belt 118 to keep the belt tight.

Figure 11:
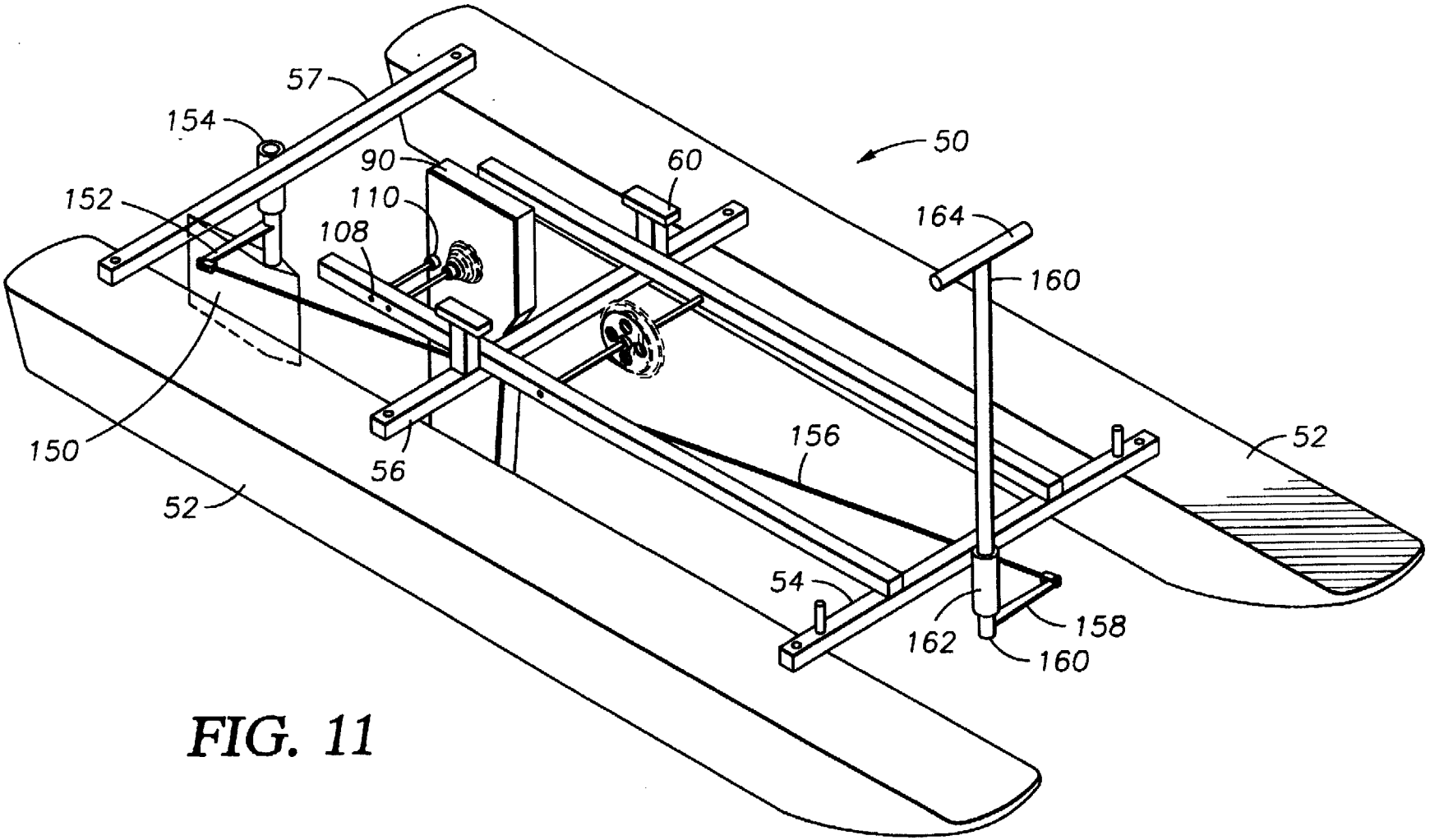
FIG. 11 is a perspective view of the steering assembly and rudder.

Now referring to FIG. 11, a partial plan view of a specific embodiment of the present invention is shown where the floatation device 50 is a pair of pontoons 52 coupled by three crossbars 54, 56 and 57. The figure shows the bellcrank 152 extending leftward of the rudder 150 and the pivot collar 154 and being pivotally connected to the steering link rod 156. The steering link rod 156 is also connected to a bellcrank 158 connected to the lower end of a steering shaft 160. The steering shaft 160 extends upward through a steering pivot 162 that has been attached to the front crossbar 54. The upper end of the steering shaft 160 includes a handlebar 164 for use in steering the device 50.

Also shown in FIG. 11, the propeller unit 90 is secured to the axle 97 spanning between the longitudinal supports 66. The propeller unit 90 is held in the down position, ready for use, with the pin 108 inserted into the reinforced hole 110. An alternate hole 111 can be used to secure the propeller unit 90 in an up position useful for beaching, moving and storing the present invention without causing damage to the propeller unit or the propeller itself.

Figure 12:
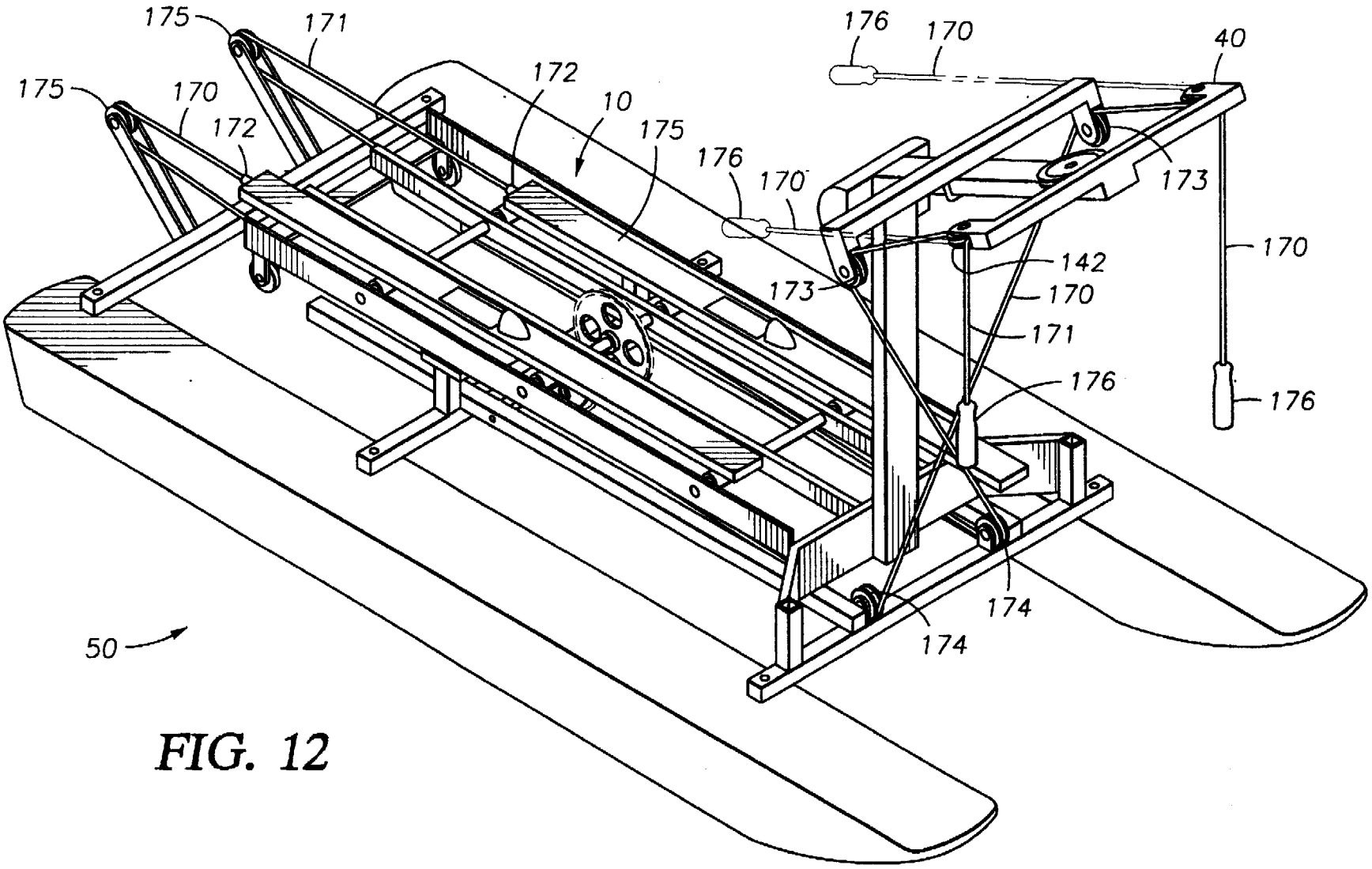
FIG. 12 is a perspective view of one embodiment of a floatation device having a ski machine mounted thereon and a pull rope system for exercising the arms that assists to power the propeller unit.

Now referring to the FIG. 12, a perspective view of one embodiment of a floatation device having a ski machine mounted thereon and a pull rope system for exercising the arms that assists to power the propeller unit. Note that the steering mechanism of FIG. 11 has been removed simply for clarity of the figures and would ordinarily be included in the device 50. The pull rope system shown in FIG. 12 is an entirely optional feature of the present invention. In fact, due to the additional construction involved and the marginal benefits in powering the propeller unit, it may be preferred to continue use of the hand-held arm exercise ropes 36, 38 and pulley 44 having controllable frictional resistance rather than the pull rope system of FIG. 12.

The optional pull rope system utilizes the individual pulleys 40, 42 of the ski machine 10 and provides various other pulleys to allow connection of left and right pull ropes 170, 171 to the tail end of the skis 174,175, respectively, preferably through a pair of eye screws 172. It is preferred that the original ski machine ropes 36, 38 of FIG. 1 are removed from the pulleys 40,42 prior to connection with the pull rope system of the present invention and fixed out of the way. Left and right pull ropes 170,171 operate independently and are threaded through pulleys 40, 42, mountable pulleys 173, front pulleys 174 and rear pulleys 175, consecutively, and attached to the eye screws 172. The distal end of the ropes 170,171 preferably have hand grips 176 attached thereto. It is vitally important to the particular pull rope system of FIG. 12 that the ropes 170,171 the left pull rope 170 be connected to pull the right ski 174 and the right pull rope 171 be connected to pull the left ski 175. This is important so that a normal ski and ski pole motion can be used, wherein the right (left) arm swings back as the left (right) leg pushes back. This connection can be accomplished in a number of ways that will be apparent to one in the art, but is accomplished in FIG. 12 by crossing the ropes in front of the ski machine 10 between the mountable pulleys 173 and front pulleys 174. The mountable pulleys 173 are necessary to smoothly direct the ropes back and downward from pulleys 40,42 to the front pulleys 174. It is preferred that the mountable pulleys 173 be disconnectably connected so that no permanent alteration to the ski machine is necessary.

In order to use the floatation device of the present invention, a ski machine must be positioned over support pads 60 with front support collars 25 secured over pegs 58. Any resistance-created devices, such as a friction strap over the flywheel 34, should be disengaged and laid aside out of the way. The floatation device is then placed into the water and the propeller unit lowered into position. The operator is then ready to climb onto the ski machine and propel the device across the water as directed by the steering assembly.

It will be understood that certain combinations and subcombinations of the invention are of utility and may be employed without reference to other features in subcombinations. This is contemplated by and is within the scope of the present invention. As many possible embodiments may be made of this invention without departing from the spirit and scope thereof, it is to be understood that all matters hereinabove set forth or shown in the accompanying drawing are to be interpreted as illustrative and not in a limiting sense.

While the foregoing is directed to the preferred embodiment, the scope thereof is determined by the claims which follow:

What is claimed is:

1. A human-powered floatation device for use with a ski machine having a flywheel, front support collars, and a base having two sides, said flotation device comprising:

(a) floatation means having sufficient buoyancy and stability to allow the ski machine and a human to maintain their balance on a surface of water; the flotation means comprising pontoons connected by a plurality of crossbars comprising forward and rear crossbars:

(b) means for firmly disconnectably connecting the ski machine to the floatation means comprising pegs attached to the front crossbar, spaced and sized to cooperate with front support collars of the ski machine; and support pads attached to the rear crossbar, spaced and sized to receive the two sides of the base of the ski machine;

(c) a drive pulley fixedly mounted on the floatation means for frictional engagement with the flywheel, wherein the drive pulley receives rotational forces from the flywheel;

(d) a propeller drive assembly having a propeller, the propeller drive assembly coupled to the drive pulley for communicating the rotational force to the propeller; and (e) a steering mechanism having a rudder;

wherein the support pads are positioned at an appropriate elevation for the flywheel to firmly engage the drive pulley.

2. A floatation device for use with a ski machine having a flywheel, comprising:

(a) floatation means having sufficient buoyancy and stability to allow a ski machine and rider to maintain their balance on a surface of water;

(b) means for firmly disconnectably connecting the ski machine to the floatation means;

(c) a drive pulley mounted on the floatation means for engagement with the flywheel, wherein the drive pulley receives rotational forces from the flywheel;

(d) a propeller drive assembly having a propeller, the propeller drive assembly coupled to the drive pulley for communicating the rotational force to the propeller, wherein the propeller drive assembly comprises:

(1) a transverse axle disconnectably connected to the rear mounting brackets;

(2) a drive gear assembly mounted concentrically about the axle comprising a chain sprocket rigidly coupled to an upper drive belt sprocket, and first and second bearings fixed at opposite ends of the assembly and engaging the axle to allow the assembly to spin freely about the axle;

(3) a rigid member downwardly depending from the axle;

(4) a lower bearing attached to the rigid member and having a rearwardly extending axis of rotation;

(5) a propeller shaft extending through the lower beating having the propeller attached to a first end and a lower drive belt sprocket coupled to a second end;

(6) a drive belt frictionally engaging the upper and lower drive belt sprockets;

(7) an idler coupled to the rigid member adjacent one of the drive belt sprockets, wherein the idler is adapted to maintain tension on the drive belt; and (8) wherein the chain sprocket cluster is freely accessible for engagement with a chain so that rotation of the drive pulley causes the propeller to push the floatation device forward; and (e) a steering mechanism having a rudder.

3. The floatation device of claim 2 further comprising a rear derailer, and wherein the drive gear assembly comprises a plurality of chain sprockets in the form of a standard multi-speed shimano chain sprocket so that the ratio of propeller turns to chain turns can be changed by activating the rear derailer.

4. The floatation device of claim 2 wherein the propeller drive assembly may pivot about the axle between an up position and a down position.

5. A floatation device for use with an exerciser having a flywheel, comprising:

(a) floatation means having sufficient buoyancy and stability to allow the exerciser and rider to maintain their balance on a surface of water;

(b) means for firmly disconnectably connecting the exerciser to the floatation means;

(c) a drive pulley mounted on the floatation means for engagement with the flywheel, wherein the drive pulley receives rotational forces from the flywheel;

(d) a propeller drive assembly having a propeller, the propeller drive assembly coupled to the drive pulley for communicating the rotational force to the propeller; and (e) a steering mechanism having a rudder; wherein the steering mechanism comprises:

(1) a steering pivot attached to the forward portion of the floatation means;

(2) a steering shaft extending upward through the steering pivot comprising an upper end with handlebars and a lower end having a front bellerank arm with a distal end;

(3) a rudder pivotally coupled to the floatation means rearward of the propeller comprising a rear bellerank arm with a distal end, wherein the rear bellerank arm and the from bellcrank arm extend to opposite sides of the floatation device; and (4) a rigid steering link having a first end pivotally coupled to the distal end of the front bellcrank arm and a second end pivotally coupled to the distal end of the rear bellerank arm so that the floatation device is steered in the same direction that the handlebars are turned.

6. The floatation device of claim 5 wherein the rudder is mounted directly behind the propeller.

7. The floatation device of claim 6 wherein the rudder has substantially flat surface area and further comprises a pivot shaft defining a point about which the rudder pivots, and wherein about 25 percent of the rudder surface area is forward of the rudder pivot point.

8. In an exerciser for simulating cross country skiing comprising a frame having first and second ends, support means on said frame and within the peripheral dimensions thereof for supporting a pair of skis, said support means comprising first and second freely rotatable roller means for each of said skis rotatably mounted adjacent the first and second ends of said frame, respectively, said first and second roller means for each of said skis being spaced apart in longitudinal direction but simultaneously engageable by skis worn by a user of the exerciser, and separate drive roller means for each of said skis at center portions of said frame and positioned between the respective first and second freely rotating rotatable roller means, said separate drive roller means for each of said skis being substantially midway between the first and second freely rotating rotatable roller means for the respective skis, a shaft member rotatably mounted on said frame, both of said separate drive roller means being mounted on said shaft, one way clutch means mounting each of said separate drive roller means to said opposite ends of said shaft, a flywheel drivably mounted on said shaft, whereby movement of each of a pair of skis supported on their respective roller means to rotate said flywheel in one direction and each of said drive roller means being free wheeling in the opposite direction from said one direction whereby energy imparted to each of said drive roller means is stored in a common flywheel;

the improvement comprising:

(a) floatation means secured below the exerciser and having sufficient buoyancy and stability to allow the exerciser and a person to balance on a surface of water;

(b) a propeller drive assembly coupled to the floatation means for propelling the floatation means across the water; and (c) means for transmitting the forces placed on the exerciser by the person to the propeller drive assembly.

9. A human-powered floatation system comprising:

(a) an exerciser device for simulating cross country skiing comprising a frame member having first and second ends, a plurality of rollers on said frame positioned to individually support a pair of skis along adjacent opposite sides of said frame, one ski in each of a pair of first and second roller paths, at least one of said rollers in each of said roller paths comprising a drive roller, each of said drive rollers being rotated upon movement of a ski engaging said drive roller, flywheel means rotatably mounted on said frame for storing energy developed by driving said drive rollers, means to drivably connect the drive rollers in each path to said flywheel means including one way clutch means, said one way clutch means being effective to disengage driving connection between each of said drive rollers and when said drive rollers are rotated in one direction of rotation and to effect driving connection between said drive rollers and the flywheel means when said drive rollers are rotated in the other direction at a speed greater than the speed necessary to overtake the rotation of the flywheel means (b) floatation means secured below the exerciser device and having sufficient buoyancy and stability to allow the exerciser device and a person to balance on a surface of water;

(c) a propeller drive assembly coupled to the floatation means for propelling the system across the water; and (d) means for transmitting the forces placed on the exerciser device by the person to the propeller drive assembly.

10. The floatation system of claim 9 wherein the means for transmitting forces comprises a drive pulley mounted on the floatation means for engagement with the flywheel.

11. The floatation system of claim 10 further comprising:

(e) a steering mechanism coupled to the floatation means.

12. A human-powered floatation device for use with a ski machine having a flywheel, front support collars and a base with two sides, said flotation device comprising:

(a) floatation means secured below the ski machine; said floatation means having sufficient buoyancy and stability to allow the ski machine and a person to balance on a surface of water; said flotation means comprising:

(1) pontoons connected by a plurality of crossbars:

(2) pegs attached to the floatation means, the pegs spaced and sized to cooperate with the front support collars of the ski machine: and (3) support pads attached to the floatation means, the support pads spaced and sized to receive the two sides of the base of the ski;

(b) a drive pulley coupled to the floatation means for frictional engagement with the flywheel, wherein the drive pulley receives rotational forces from the flywheel:

(c) a propeller drive assembly coupled to the floatation means for propelling the system across the water; and (d) a steering mechanism having a rudder coupled to the floatation means.

13. A human-powered floatation device for use with an exerciser, comprising:

(1) floatation means secured below the exerciser: said floatation means having sufficient buoyancy and stability to allow the exerciser and a person to balance on surface of water;

(2) a propeller drive assembly coupled to the floatation means for propelling the system across the water comprising:

(a) a transverse axle disconnectably connected to the floatation means;

(b) a drive gear assembly mounted concentrically about the axle comprising a chain sprocket rigidly coupled to an upper drive belt sprocket;

(c) a rigid member downwardly depending from the axle;

(d) a lower bearing attached to the rigid member and having a rearwardly extending axis of rotation;

(e) a propeller shaft extending through the lower bearing having a propeller attached to a first end and a lower drive belt sprocket coupled to a second end;

(f) a drive belt frictionally engaging the upper and lower drive belt sprockets;

(g) all idler coupled to the rigid member adjacent one of the drive belt sprockets;

(h) wherein the chain sprocket cluster is accessible for engagement with a chain so that rotation of the drive pulley causes the propeller to push the floatation device forward; and (3) means for transmitting the forces placed on the exerciser by the person to the propeller drive assembly.

14. The floatation device of claim 13, wherein the force transmitting means comprises a drive pulley fixedly mounted on the floatation means for frictional engagement with a wheel on the exerciser.

15. The floatation device of claim 14, wherein the wheel is a flywheel.

16. The floatation device of claim 13, wherein the force transmitting means comprises a drive pulley fixedly mounted on the floatation means for frictional engagement with a belt on the exerciser.

17. The floatation device of claim 16, wherein the belt is a treadmill belt.

18. The floatation device of claim 13, further comprising a rear derailer, and wherein the drive gear assembly comprises a plurality of chain sprockets in the form of a standard multi-speed shimano chain sprocket so that the ratio of propeller rams to chain turns can be changed by activating the rear derailer.

19. The floatation device of claim 13, wherein the housing may pivot about the axle between an up position and a down position.

20. The floatation system of claim 13 further comprising a steering mechanism coupled to the floatation means.

21. A human-powered floatation device for use with an exerciser, comprising:

(1) floatation means secured below the exerciser: said floatation means having stability to allow sufficient buoyancy and the exerciser and a person to balance on a surface of water:

(2) a propeller drive assembly coupled to the floatation means for propelling the system across the water:

(3) means for transmitting the forces placed on the exerciser by the person to the propeller drive assembly: and (4) a steering mechanism coupled to the floatation means comprising:

(a) a steering pivot attached to the forward portion of the floatation means;

(b) a steering shaft extending upward through the steering pivot comprising an upper end with handlebars and a lower end having a front bellcrank arm with a distal end;

(c) a rudder pivotally coupled to the floatation means rearward of the propeller comprising a rear bellcrank arm with a distal end, wherein the rear bellcrank arm and the front bellerank arm extend to opposite sides of the floatation device; and (d) a steering link having a first end pivotally coupled to the distal end of the front bellcrank arm and a second end pivotally coupled to the distal end of the rear bellcrank arm so that the floatation device is steered in the same direction that the handlebars are turned.

22. The floatation device of claim 21, wherein the rudder is mounted directly behind the propeller.

23. The floatation device of claim 22, wherein the rudder has substantially flat surface area and further comprises a pivot shaft defining a point about which the rudder pivots, and wherein about 25 percent of the rudder surface area is forward of the rudder pivot point.

* * * * *